US008955275B2

(12) United States Patent
Stahl, Jr.

(10) Patent No.: US 8,955,275 B2
(45) Date of Patent: Feb. 17, 2015

(54) HEAD-OF-WALL FIRESTOPPING INSULATION CONSTRUCTION FOR FLUTED DECK

(71) Applicant: Specified Technologies Inc., Somerville, NJ (US)

(72) Inventor: James P. Stahl, Jr., Princeton Junction, NJ (US)

(73) Assignee: Specified Technologies Inc., Somerville, NJ (US)

( * ) Notice: Subject to any disclaimer, the term of this patent is extended or adjusted under 35 U.S.C. 154(b) by 0 days.

(21) Appl. No.: 13/999,153

(22) Filed: Jan. 17, 2014

(65) Prior Publication Data

US 2015/0007515 A1 Jan. 8, 2015

Related U.S. Application Data

(60) Provisional application No. 61/957,632, filed on Jul. 8, 2013.

(51) Int. Cl.
*E04C 2/00* (2006.01)
*E04B 1/94* (2006.01)

(52) U.S. Cl.
CPC . *E04B 1/945* (2013.01); *E04B 1/94* (2013.01); *E04B 1/948* (2013.01)
USPC ..... 52/232; 52/243; 52/317

(58) Field of Classification Search
CPC ..... E04B 2/7411; E04B 2/7457; E04B 2/58; E04B 2/76; E04B 2/82; E04B 1/94; E04B 1/948
USPC ..... 52/232, 241, 242, 243, 317, 220.8, 52/481.1, 483.1, 656.3, 2.15, 2.17, 2.23, 52/404.1
See application file for complete search history.

(56) References Cited

U.S. PATENT DOCUMENTS

| | | | | |
|---|---|---|---|---|
| 4,106,249 | A | 8/1978 | Morton | |
| 4,114,335 | A | 9/1978 | Carroll | |
| 4,274,239 | A | 6/1981 | Carroll | |
| 4,351,870 | A | 9/1982 | English, Jr. | |
| 4,507,901 | A | 4/1985 | Carroll | |
| 4,619,471 | A | 10/1986 | Harbeke | |
| 5,001,883 | A | 3/1991 | Landheer | |
| 5,293,724 | A | 3/1994 | Cornwall | |
| 5,755,066 | A | 5/1998 | Becker | |
| 5,913,788 | A | 6/1999 | Herren | |
| 6,058,668 | A | 5/2000 | Herren | |
| 6,216,404 | B1 | 4/2001 | Vellrath | |
| 6,405,502 | B1 * | 6/2002 | Cornwall | 52/220.8 |
| 6,698,146 | B2 | 3/2004 | Morgan et al. | |
| 6,783,345 | B2 * | 8/2004 | Morgan et al. | 425/110 |
| 7,043,880 | B2 * | 5/2006 | Morgan et al. | 52/2.23 |
| 7,152,385 | B2 * | 12/2006 | Morgan et al. | 52/745.05 |

(Continued)

*Primary Examiner* — James Ference
(74) *Attorney, Agent, or Firm* — Sperry, Zoda & Kane

(57) ABSTRACT

A firestopping insulation construction adapted to be positioned adjacent to a head-of-wall area beneath a ceiling construction having fluted ceiling runner channels which have a trapezoidal cross-sectional profile facing downwardly. The insulation assembly includes an upper plug mated the shape of the fluted channel which is at least partially surrounded by an outer cover and further includes a lower insulation section extending over the side walls of the head-of-wall area. The upper insulation plug and the lower insulation sections are preferably made of molded high temperature insulation. The insulation assembly is engaged only frictionally to the fluted ceiling channels.

18 Claims, 12 Drawing Sheets

(56) References Cited

U.S. PATENT DOCUMENTS

| | | | | |
|---|---|---|---|---|
| 7,617,643 | B2 | 11/2009 | Pilz et al. | |
| 7,681,365 | B2 * | 3/2010 | Klein | 52/232 |
| 7,752,817 | B2 * | 7/2010 | Pilz et al. | 52/207 |
| 7,775,006 | B2 | 8/2010 | Giannos | |
| 7,814,718 | B2 * | 10/2010 | Klein | 52/232 |
| 7,841,148 | B2 | 11/2010 | Tonyan et al. | |
| 7,849,648 | B2 | 12/2010 | Tonyan et al. | |
| 7,866,108 | B2 * | 1/2011 | Klein | 52/483.1 |
| 7,950,198 | B2 | 5/2011 | Pilz et al. | |
| 8,001,737 | B1 | 8/2011 | Price | |
| 8,056,293 | B2 * | 11/2011 | Klein | 52/483.1 |
| 8,065,852 | B2 | 11/2011 | Tonyan et al. | |
| 8,069,633 | B2 | 12/2011 | Tonyan et al. | |
| 8,074,412 | B1 | 12/2011 | Gogan et al. | |
| 8,087,205 | B2 | 1/2012 | Pilz et al. | |
| 8,132,376 | B2 * | 3/2012 | Pilz et al. | 52/207 |
| 8,136,314 | B2 * | 3/2012 | Klein | 52/232 |
| 8,151,526 | B2 * | 4/2012 | Klein | 52/232 |
| 8,181,404 | B2 | 5/2012 | Klein | |
| 8,322,094 | B2 * | 12/2012 | Pilz et al. | 52/232 |
| 2003/0079425 | A1 * | 5/2003 | Morgan et al. | 52/232 |
| 2003/0089062 | A1 * | 5/2003 | Morgan et al. | 52/317 |
| 2003/0200721 | A1 * | 10/2003 | Gleeson et al. | 52/746.1 |
| 2003/0213211 | A1 * | 11/2003 | Morgan et al. | 52/745.05 |
| 2004/0045234 | A1 * | 3/2004 | Morgan et al. | 52/232 |
| 2006/0137293 | A1 * | 6/2006 | Klein | 52/782.1 |
| 2009/0090074 | A1 * | 4/2009 | Klein | 52/232 |
| 2009/0094912 | A1 * | 4/2009 | Klein | 52/232 |
| 2009/0223159 | A1 | 9/2009 | Colon | |
| 2010/0126092 | A1 * | 5/2010 | Pilz et al. | 52/232 |
| 2011/0099928 | A1 * | 5/2011 | Klein et al. | 52/232 |
| 2011/0167742 | A1 * | 7/2011 | Klein | 52/232 |
| 2011/0185656 | A1 | 8/2011 | Klein | |
| 2011/0247281 | A1 * | 10/2011 | Pilz et al. | 52/173.1 |
| 2011/0314757 | A1 | 12/2011 | Pilz et al. | |
| 2012/0066989 | A1 * | 3/2012 | Pilz et al. | 52/232 |

* cited by examiner

HEAD-OF-WALL FIRESTOPPING INSULATION CONSTRUCTION FOR FLUTED DECK

The present utility application hereby formally claims priority of currently U.S. Provisional Patent application No. 61/852,351 filed Mar. 15, 2013 on a "Head-of-Wall Firestopping Insulation Construction For Positioning In Engagement With A Fluted Deck Thereabove" filed by same inventor as listed herein, namely, James P. Stahl Jr., and assigned to the same assignee as listing herein, namely, Specified Technologies Inc., and said referenced provisional application is hereby formally incorporated by reference as an integral part of the present application.

The present utility application hereby also formally claims priority of currently U.S. Provisional Patent application No. 61/957,632 filed Jul. 8, 2013 on a "Head-of-Wall Firestopping Insulation Construction For Positioning In Engagement With A Fluted Deck Thereabove" filed by the same inventor as listed herein, namely, James P. Stahl Jr., and assigned to the same assignee as listing herein, namely, Specified Technologies Inc., and said referenced provisional application is hereby formally incorporated by reference as an integral part of the present application.

BACKGROUND OF THE INVENTION

1. Field of the Invention

The present invention deals with the field related to a method of sealing the top track, that is, the ceiling runner channel with respect to a wall prior to or subsequent to the insulation of the wall studs and gypsum board extending thereover. Sealing of this area is normally more difficult after the studs and gypsum board have been placed and the wall construction is fully assembled in place. However, the insulation system of the present invention can be installed before the wall and ceiling constructions of a building are built or can be stall after initial installation thereof as an after-market add-on to the initial construction. Currently, the primary system used for insulating such head-of-wall areas immediately below fluted steel decks is to simply apply a firestopping gasket system on top of the track and securing it to the bottom of the floor thereabove. This construction is an excellent solution for flat concrete slabs, but for ceilings that include a fluted deck which define ceiling runner channels facing downwardly, it is necessary to include an additional firestopping pillow positioned in each of the flute areas above a wall which is packed into the void area therein seal the head-of-wall-area for achieving firestopping between the wall structure and the fluted deck thereabove. Such ceiling runner channels will conventional have a generally trapezoidal cross-sectional shape in the flute recesses thereof. This conventional solution is time consuming, labor intensive and a better firestopping insulation system is currently needed. This need is filled by the system of the present invention.

2. Description of the Prior Art

Many patents have been issued for head-of-wall firestopping constructions which are designed to mate with a fluted steel deck thereabove in various manners such as shown in U.S. Pat. No. 4,106,249 patented Aug. 15, 1978 to Virgil R. Morton and assigned to Verco Manufacturing, Inc. on a "Method and Apparatus For Interlocking and Venting a Structural Diaphragm"; and U.S. Pat. No. 4,114,335 patented Sep. 19, 1978 to Frank E. Carroll and assigned to Carroll Research, Inc. on a "Sheet Metal Structural Shape And Use In Building Structures"; and U.S. Pat. No. 4,274,239 patented Jun. 23, 1981 to Frank E. Carroll and assigned to Carroll Research, Inc. on a "Building Structure"; and U.S. Pat. No. 4,351,870 patented Sep. 28, 1982 to Edgar English, Jr. on "Maximized Strength-To-Weight Ratio Panel Material"; and U.S. Pat. No. 4,507,901 patented Apr. 2, 1985 to Frank E. Carroll on a "Sheet Metal Structural Shape And Use In Building Structures"; and U.S. Pat. No. 4,619,471 patented Oct. 28, 1986 to Gerold J. Harbeke on an "Embedded Pipe Coupling Holder"; and U.S. Pat. No. 5,001,883 patented Mar. 26, 1991 to Hugo A. J. Landheer and assigned to Hunter Douglas International N.V. on a "Sandwich Panel For Ceiling Application"; and U.S. Pat. No. 5,293,724 patented Mar. 15, 1994 to Kenneth R. Cornwall on a "Coupling Assembly For Corrugated Decks And Method For Connecting Thereto"; and U.S. Pat. No. 5,755,066 patented May 26, 1998 to Duane William Becker on a "Slip Track Assembly"; and U.S. Pat. No. 5,913,788 patented Jun. 22, 1999 to Thomas R. Herren on a "Fire Blocking And Seismic Resistant Wall Structure"; and U.S. Pat. No. 6,058,668 patented May 9, 2000 to Thomas R. Herren on a "Seismic And Fire-Resistant Head-Of-Wall Structure"; and U.S. Pat. No. 6,216,404 patented Apr. 17, 2001 to Timothy Vellrath on a "Slip Joint And Hose Stream Deflector Assembly"; and U.S. Pat. No. 6,698,146 patented Mar. 2, 2004 to Michael D. Morgan et al and assigned to W.R. Grace & Co.-Conn on "In Situ Molded Thermal Barriers"; and U.S. Pat. No. 7,043,880 patented May 16, 2006 to Michael D. Morgan et al and assigned to W. R. Grace & Co.-Conn on "In Situ Molded Thermal Bathers"; and U.S. Pat. No. 7,617,643 patented Nov. 17, 2009 to Don A. Pilz et al and assigned to California Expanded Metal Products Company on a "Fire-Rated Wall Construction Product"; and U.S. Pat. No. 7,775,006 patented Aug. 17, 2010 to Konstantinos Giannos on a "Fire Stop System For Wallboard And Metal Fluted Deck Construction"; and U.S. Pat. No. 7,841,148 patented Nov. 30, 2010 to Timothy D. Tonyan et al and assigned to United States Gypsum Company on "Non-Combustible Reinforced Cementitious Lightweight Panels And Metal Frame System For Roofing"; and U.S. Pat. No. 7,849,648 patented Dec. 14, 2010 to Timothy D. Tonyan et al and assigned to United States Gypsum Company on "Non-Combustible Reinfored Cementitious Lightweight Panels And Metal Frame System For Flooring"; and U.S. Pat. No. 7,950,198 patented May 31, 2011 to Don A. Pilz et al and assigned to California Expanded Metal Products Company on a "Fire-Rated Wall Construction Product"; and U.S. Pat. No. 8,001,737 patented Aug. 23, 2011 to Darrell W. Price and assigned to Mhubbard 09, LLC on "Corrugated Deck Sealing Devices, Apparatus, Systems And Methods Of Installation"; and U.S. Pat. No. 8,065,852 patented Nov. 29, 2011 to Timothy D. Tonyan et al and assigned to U.S. Gypsum Company on "Non-Combustible Reinforced Cementitious Lightweight Panels And Metal Frame System For Roofing"; and U.S. Pat. No. 8,069,633 patented Dec. 6, 2011 to Timothy D. Tonyan et al and assigned to U.S. Gypsum Company on "Non-Combustible Reinforced Cementitious Lightweight Panels And Metal Frame System For Flooring"; and U.S. Pat. No. 8,074,412 patented Dec. 13, 2011 to Thomas Gogan et al on a "Fire And Sound Resistant Insert For A Wall"; and U.S. Pat. No. 8,087,205 patented Jan. 3, 2012 to Don A. Pilz et al and assigned to California Expanded Metal Products Company on a "Fire-Rated Wall Construction Product"; and U.S. Pat. No. 8,181,404 patented May 22, 2012 to James Alan Klein on "Head-Of-Wall Fireblocks And Related Wall Assemblies"; and United States Patent Publication No. 2009/0223159 published Sep. 10, 2009 to Mark Colon on a "Firestop Block And Thermal Barrier System For Fluted Metal Decks"; and United States Publication No. 2011/0185656 published Aug. 4, 2011 to James A. Klein on a "Fire Retardant Cover For Fluted Roof Deck; and United States Patent Publication No. 2011/0314757 published Dec. 29, 2011 to Don A. Pilz et al and assigned to California Expanded Metal Products Company on a "Fire-Rated Wall And Ceiling System".

SUMMARY OF THE INVENTION

The present invention provides a unique construction for head-of-wall firestopping which is usable with a specific configuration of the ceiling. Many ceilings in various building constructions include a fluted ceiling deck which includes usually a plurality of ceiling runner channels extending thereacross with recessed areas defined therein facing downwardly having a generally trapezoidal cross section. Each of the ceiling runner channels will include an upper recessed panel extending approximately horizontally and a first recess side panel engaging the upper recess panel and extending downwardly and outwardly with respect thereto. Also included will be a second recess side panel engaging the upper recess panel at a position spatially disposed from the first recess side panel and extending downwardly and outwardly from the upper recess panel in a direction extending away from the first recess side panel.

The wall construction with which the head-of-wall firestopping apparatus of the present invention is usable is generally included extending vertically and is positioned immediately below the head-of-wall area and is defined by a plurality of wall studs with a first gypsum board construction attached on one side thereof and a second gypsum board construction attached on the other side thereof normally spatially disposed from the first gypsum board construction.

The head-of-wall firestopping construction will preferably include a first insulation member of fire insulating material positioned extending into the recessed area defined in the ceiling such as to in frictional engagement with respect to the fluted ceiling deck and extending downwardly therefrom into the head-of-wall area. This insulation member will preferably include a first upper insulation section formed of fire insulating material such as resin-impregnated moldable mineral wool or fiber. The first upper insulation section will extend into the recessed area defined above into a ceiling runner channel in the ceiling above and will abut with respect to the fluted ceiling deck in the recessed areas thereof. This first upper insulation section will preferably include a first upper insulation horizontal surface defined extending approximately horizontally therein. The first upper insulation section will further include a first upper insulation primary incline surface attached to the first upper insulation horizontal surface and extending downwardly and outwardly therefrom. The first upper insulation primary inclined surface will be positioned in abutment with respect to a first recess side panel for facilitating frictionally movable attachment with respect thereto.

The first upper insulation section will further include a first upper insulation sectionary inclined surface attached to the first upper insulation horizontal surface at a position spatially disposed from the first upper insulation primary inclined surface and extending downwardly and outwardly therefrom. The first upper insulation secondary inclined surface will preferably be positioned in abutment with a second recess side panel for facilitating frictionally movable attachment with respect thereto. The first upper insulation section will further include a first upper insulation exterior surface extending generally vertically and facing outwardly with respect to the head-of-wall area above the first gypsum board construction.

The first insulation member will also include a first lower insulation section of fire insulating material attached to the first upper insulation section and extending downwardly therefrom to a position in abutment with and extending over the first gypsum board construction for firestopping thereadjacent. The first lower insulation section will preferably define a first lower insulation exterior surface extending generally vertically and facing outwardly from the head-of-wall area. The head-of-wall insulation construction will further include a second insulation member also formed of a fire resistant material such as resin-impregnated moldable mineral wool or fiber. The second insulation member will be positioned to extend into a recessed area defined in the ceiling such as to be in frictional engagement with respect to the fluted ceiling deck and extending downwardly therefrom into the head-of-wall area. The insulation member will preferably include a second upper insulation section of fire insulating material extending into a recessed area defined thereabove in a ceiling runner channel in the ceiling into abutment with respect to the fluted ceiling deck and the recessed area thereof. The first upper insulation section will further include a second upper insulation horizontal surface defined extending approximately horizontally thereon. Second upper insulation section will also include a second upper insulation primary inclined surface attached to the second upper insulation surface horizontal surface and extending downwardly and outwardly therefrom. The second upper insulation primary inclined surface will preferably be positioned in abutment with a first recessed side panel for facilitating frictionally engagement with respect thereto. The second upper insulation section will further include a second upper insulation secondary inclined surface attached to the second upper insulation surface at a position spatially disposed from the second upper insulation primary inclined surface and extending downwardly and outwardly therefrom. The second upper insulation secondary inclined surface will be positioned in abutment with the second recess side panel for facilitating frictionally movable attachment with respect thereto. Further included will be a second upper insulation exterior surface defined extending generally vertically and facing outwardly with respect to the head-of-wall area positioned extending outwardly and above the second gypsum board construction. The second insulation member will further include a second lower insulation section of fire insulating material attached to the second upper insulation section at a position spatially disposed from the first lower insulation section and extending downwardly therefrom to a position in abutment with and extending over the second gypsum wall board construction for firestopping thereadjacent. The second lower insulation section will define a second lower insulation exterior surface extending generally vertically and facing outwardly from the head-of-wall area. Furthermore the head-of-wall firestopping insulation will include a first cover attached to the first insulation member and positioned extending at least partially across the first upper insulation exterior surface and at least partially across the first lower insulation exterior surface for enhancing firestopping of the first insulation member. Furthermore a second cover will preferably be included attached to the second insulation member and positioned extending at least partially across the second upper insulation exterior surface and at least partly across the second lower insulation exterior surface for the purpose of enhancing the firestopping capabilities of the second insulation member.

Alternatively, the construction of the present invention can combine the first insulation member and the second insulation member together as a single integral unit to form a single piece head-of-wall firestopping component with a single upper insulation section and a first and second lower insulation section which extend downwardly over the outer facings of the first and second gypsum board construction of the wall construction.

It is an object of the present invention to provide a head-of-wall firestopping insulation construction which can be used in engagement with a fluted deck thereabove for firestop sealing thereagainst.

It is an object of the present invention to provide a head-of-wall firestopping construction which can include an intumescent or non-intumescent firestopping material such as mineral wool to effectively seal the head-of-wall area.

It is an object of the present invention to provide a head-of-wall firestopping construction which is of simple effective construction and has a minimum number of moving parts.

It is an object of the present invention to provide a head-of-wall firestopping construction which is easily and inexpensively maintained.

It is an object of the present invention to provide a head-of-wall firestopping construction which has minimal maintenance requirements.

It is an object of the present invention to provide a head-of-wall firestopping construction which can effectively seal the undersurface of ceiling decks which have convoluted configurations such as those including ceiling runner channels having trapezoidally-shaped cross-sections It is an object of the present invention to provide a head-of-wall firestopping construction which can achieve effective insulation with conventional insulating material such as mineral wool and/or ceramic fiber.

It is an object of the present invention to provide a head-of-wall firestopping construction which includes a separate section of the assembly which projects vertically down to cover the open top of the joint, but not within it, and in this manner allow for the joint to move up and down due to normal deflections without distressing the material within the joint or encumbering the amount of movement.

It is an object of the present invention to provide a head-of-wall firestopping construction which maintains the insulating material encapsulated within an outer housing by frictional engagement within the head-of-wall area.

It is an object of the present invention to provide a head-of-wall firestopping construction which can be installed in two different ways, that is, it can either be installed immediately after the track is fastened to the underside of the deck, or it can be installed after the wall has been fully constructed, sheathed and finished.

It is an object of the present invention to provide a head-of-wall construction which allows installation persons to slide gypsum board vertically therepast during installation of the wall construction.

BRIEF DESCRIPTION OF THE DRAWINGS

While the invention is particularly pointed out and distinctly described herein, a preferred embodiment is set forth in the following detailed description which may be best understood when read in connection with the accompanying drawings, in which.

DETAILED DESCRIPTION OF THE PREFERRED EMBODIMENT

Figure 1:
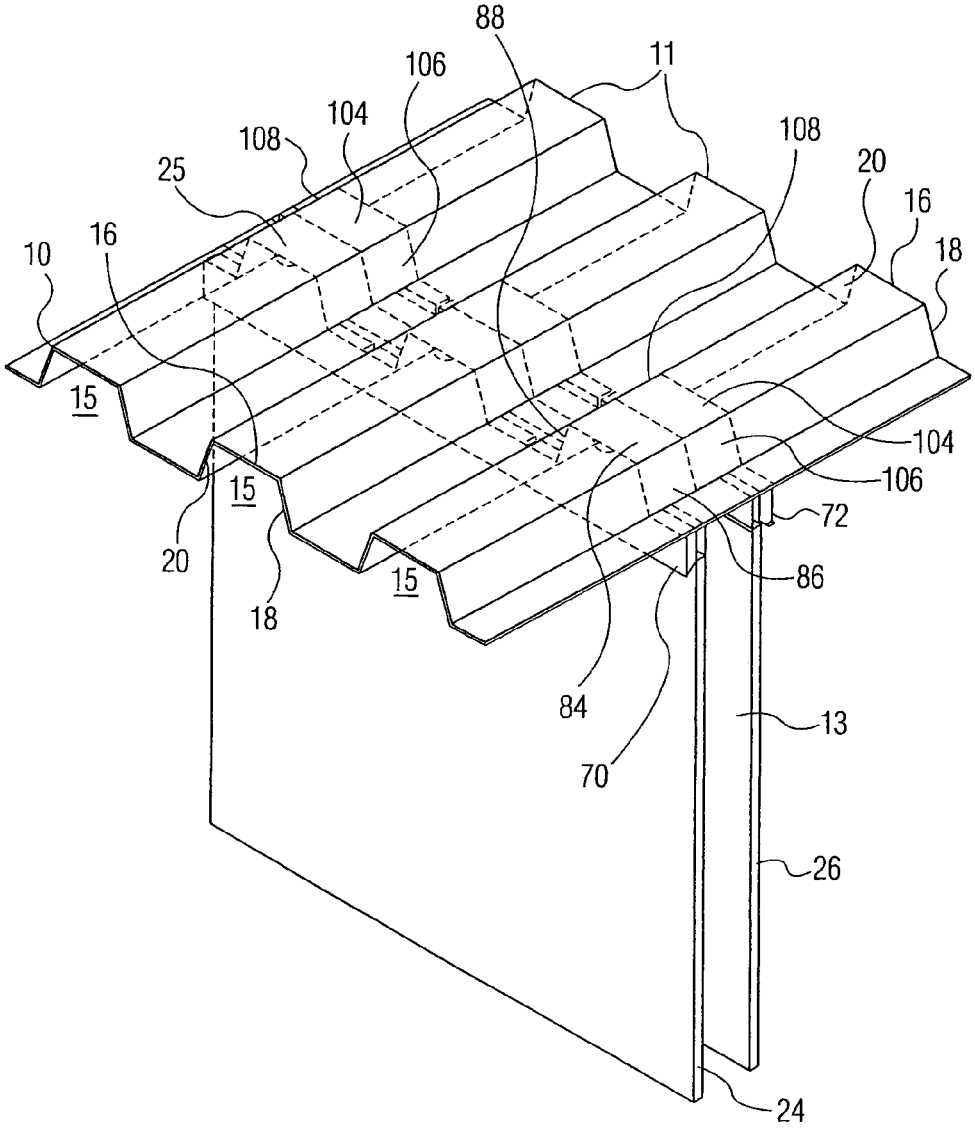
FIG. 1 is a perspective illustration of an embodiment of the head-of-wall firestopping construction of the present invention shown in position extending between a fluted ceiling deck thereabove and a wall construction therebelow.

The present invention provides a unique construction for an insulation means for firestop sealing in the head-of-wall area between wall construction and ceiling construction in building construction applications. Normally, this insulation means is made from a high temperature insulating material such as mineral wool or ceramic fiber and can possibly be intumescent, but need not be.

The present invention provides a conveniently usable configuration for a head-of-wall firestopping construction which preferably includes a first insulation member 80 having a first upper insulation section 82 and a first lower insulation section 44. It also includes a second insulation member 100 having a second upper insulation section 102 and a second lower insulation member 54. These two insulation member 80 and 100 are designed to seal each side of a head-of-wall area 25 and extend from a position adjacent the gypsum board construction of the wall construction 13 upwardly into recessed areas 15 defined in ceiling runner channels 11 within a fluted ceiling deck 10 of a ceiling 12 thereabove. By sealing each lateral side of the head-of-wall area 25 effective firestopping is achieved.

The firestopping construction of the present invention is usable for sealing a head-of-wall area which is defined below a ceiling 12 which includes fluted ceiling deck 10 and at least one or more ceilings runner channels 11 extending therethrough which define recessed areas 15 therein facing downwardly toward the head-of-wall area 25 therebelow. The ceiling runner channels 11 will preferably include upper recess panels 16 extending generally horizontally therewithin. The ceiling runner channels 11 will include not only the generally horizontally extending upper recess panel 16 but also a first recess side panel 18 engaging the upper recess panel 16 and extending downwardly and outwardly therefrom. Also included within the ceiling runner channel 11 will be a second recess side panel 20 engaging the upper recess panel 16 at a position spatially disposed from the first recess side panel 18 and extending downwardly and outwardly from the upper recess panel 16 in a direction extending away from the first recess side panel.

The wall construction 13 which is positioned immediately below the head-of-wall area 25 will include a plurality of wall studs 23 which will usually be steel but can be made of any material particularly wood but usually steel and will include a first gypsum board construction 24 attached thereto and a second gypsum board construction 26 attached thereto oppositely positioned from the board construction 24.

The head-of-wall firestopping construction usable in a head-of-wall area positioned between such a fluted ceiling deck 10 and a wall construction 13 therebelow will preferably include a first insulation member 80 of preferably mineral wood or other fire insulating material positioned extending into a recessed area 15 defined in the ceiling 12. It is preferably positioned in frictional engagement with respect to the fluted ceiling deck 10 and extends downwardly therefrom into the head-of-wall area 25.

This insulation member in more detail includes a first insulation member 80 of fire resistant material or fire insulating material positioned extending into the recessed area 15 defined in the ceiling 12 in order to be in frictional engagement with respect to the fluted ceiling deck and extending downwardly therefrom into the head-of-wall area 25. Said first insulation member 80 will include a first upper insulation section 82 of the same fire insulating material extending into the recessed area 15 defined above in a ceiling runner channel 11 in the ceiling 12 into abutment with respect to the fluted ceiling deck 10 in the recessed areas 15 thereof. The first upper insulation section 82 will include a first upper insulation horizontal surface 84 defined extending approximately horizontally thereon. Also the first upper insulation section 82 will further include a first upper insulation primary inclined surface 86 attached to the first upper insulation horizontal surface 84 and extending downwardly and outwardly therefrom. The first upper insulation primary inclined surface 86 is preferably positioned in abutment with a first recess panel 118 for facilitating frictionally movable engagement with respect thereto. The first upper insulation section 82 will further include a first upper insulation secondary inclined surface 88 attached to the first upper insulation horizontal surface 84 at a position spatially disposed from the first upper insulation primary inclined surface 86 and extending downwardly and outwardly therefrom. The first upper insulation secondary inclined surface 88 will be preferably positioned in abutment with the second recess side panel 20 for facilitating frictionally movable attachment with respect thereto. It will also include a first upper insulation exterior surface 40 extending generally vertically and facing outwardly with respect to the head-of-wall area 25 adjacent and above the first gypsum board construction 24. The first insulation member 80 will further include a first lower insulation section 44 formed of fire insulating material such as resin-impregnated moldable mineral wool and be attached to the first upper insulation section 82 to extend downardly therefrom to a position in abutment with and extending over the first gypsum board construction 24 for firestopping thereadjacent. The first lower insulation section 44 will define a first lower insulation exterior surface 45 extending generally vertically and facing outwardly from the head-of-wall area 25.

The head-of-wall insulation construction of the present invention will further include a second insulation member 100 which is similarly configured to the first insulation member 80 and is preferably identically configured to facilitate use and inventory control thereof. Second insulation member 100 will extend be formed of similar fire insulating materials and will be adapted to extend into recessed areas 15 defined in the ceiling 12 and will be capable of being brought into frictional engagement with respect to the fluted ceiling deck 10 and extending downwardly therefrom into the head-of-wall area 25. The second insulation member 100 will preferably include a second upper insulation section 102 of fire insulating material which will extend into the recessed area 15 defined thereabove in a ceiling runner channel 11 in the ceiling 12 and will extend into abutment with respect to the fluted ceiling deck 10 in the recessed areas 15. The first upper insulation section 102 will include a second upper insulation horizontal surface 104 defined extending approximately horizontally thereon. Second upper insulation section 102 will further include a second upper insulation primary inclined surface 106 attached to the second upper insulation horizontal surface 104 and oriented extending downwardly and outwardly therefrom. The second upper insulation primary inclined surface 106 will be positioned in abutment with the first recessed side panel 18 for facilitating frictional movable attachment with respect thereto. The second upper insulation section 102 will further include a second upper insulation secondary inclined surface 108 attached to the second upper insulation horizontal surface 104 at a position spatially disposed from the second upper insulation primary inclined surface 106 and oriented extending downwardly and outwardly therefrom. The second upper insulation secondary inclined surface 108 is preferably positioned in abutment with the second recessed side panel 20 for facilitating frictionally movable attachment with respect thereto.

The second upper insulation section 102 will further include a second upper insulation exterior surface 42 extending generally vertically and facing outwardly with respect to the head-of-wall area 25 and positioned extending outwardly and above the second gypsum board construction 26. The second insulation member 100 will further include a second lower insulation section 54 of fire insulating material attached to the second upper insulation section 102 at a position spatially disposed from the first lower insulation section 44 and extending downwardly therefrom to a position in abutment with and extending over the second gypsum board construction 26 for firestopping thereadjacent. The second lower insulation section 54 will define a second lower insulation exterior surface 55 extending generally vertically and facing outwardly from the head-of-wall area 25.

Further included in the construction of the head-of-wall area firestopping construction of the present invention is a first cover 70 which is attached to the first insulation member 80 and positioned extending at least partially across the first upper insulation exterior surface 40 and at least partially across the first lower insulation exterior surface 45 for the purpose of enhancing firestopping of first insulation member 80. Furthermore the firestopping construction includes a second cover 72 attached to the second insulation member 100 and positioned extending at least partially across the second upper insulation exterior surface 42 and at least partially across the second lower insulation exterior surface 55 for enhancing firestopping of the second insulation member 100. In the preferred configuration of the present invention the first insulation member 80 and the second insulation member 100 are made of a molded mineral wool material. Furthermore for enhanced firestopping it is also possible that the first cover 70 and the second cover 72 can be made of a paper material with an intumescent component impregnated therewithin to facilitate firestopping characteristics of the head-of-wall firestopping apparatus. In this embodiment the first upper insulation section 82 of the first insulation member 80 and the second upper insulation section 102 of the second insulation 100 are preferably positioned within the head-of-wall area such as to extend upwardly into a recessed area 15 to a position spatially disposed from one another to facilitate the use of head-of-wall firestopping construction of the present invention for firestopping wall constructions of various widths. As such, when positioned apart from one another the first upper insulation 82 and the second upper insulation section 102 will define a void therebetween and the lateral dimensions of this void can be varied and made larger for large walls and in this manner allow a single size and configuration of firestopping construction to be usable with walls having various thicknesses.

Also it is possible with the apparatus of the present invention that the first upper insulation section 82 of the first insulation member 80 and the second upper insulation section 102 of the second insulation member 100 can be positioned within the head-of-wall area and extended into the recessed area 15 at a position wherein they are in direct abutment with respect to one another and in this manner further enhanced firestopping within the head-of-wall area. It should be appreciated that this configuration is only for a single conventional or standard width thickness of wall. Wider thicknesses of wall will require the first upper insulation section 82 and the second upper insulation section 102 to be spaced apart from one another rather than in direct abutment with respect to one another.

In a preferred configuration of the present invention the first lower insulation section 44 will define a first lower insulation lower surface 46 facing generally downwardly. The second lower insulation section 54 will define a second lower insulation lower surface 56 facing generally downwardly therefrom. With this configuration the head-of-wall firestopping construction will further include a first lower surface lower cover 47 extending over the first lower insulation lower surface 46. Furthermore a second lower surface lower cover 57 will be included extending over the second lower insulation surface 56 for enhancing firestopping of the first lower insulation section 44 and the second lower insulation section 54. It is also possible that the first lower surface lower cover 47 and the second lower surface lower cover 57 will be made of a paper material impregnated with an intumescent component therein to facilitate firestopping.

With this construction the first lower insulation lower surface 46 can include a first lower insulation lower truncated surface 48 positioned immediately adjacent to the first gypsum board construction 24 and oriented inclined upwardly and inwardly with respect thereto. In this manner relative movement of the first gypsum board construction 24 upwardly during installation thereof into a position between the wall studs 23 and the first lower insulation member 44 can be enhanced due to the upwardly and inwardly directed angle of inclination of the first lower insulation lower truncated surface 48. In a similar manner the second lower insulation lower surface 56 can define a second lower insulation lower truncated surface 58 positioned immediately adjacent to the second gypsum board construction 26. This surface 58 will be oriented inclined upwardly and inwardly with respect to the gypsum board construction 26 to facilitate relative movement of the gypsum board construction upwardly vertically into position for installation with respect to the wall studs 23 during initial construction thereof. In this manner movement of the second gypsum board construction 26 to a position between the wall studs 23 and the second lower insulation section 54 can be facilitated.

In a further preferred configuration the first lower insulation section 44 will preferably include a first lower insulation interior surface 49 positioned immediately adjacent to and facing the first gypsum board construction 24 for the purpose of facilitating firestopping thereadjacent. In this configuration the second lower insulation section 54 will include a second lower insulation interior surface 59 positioned immediately adjacent to and facing the second gypsum board construction 24 to facilitate firestopping thereadjacent.

To facilitate firestopping by the first and second lower insulation sections 44 and 54 the firestopping construction of the present invention can include a first lower insulation interior cover 50 positioned extending over the first lower insulation interior surface 49 and adjacent to the first gypsum board construction to facilitate firestopping thereover. Further included can be a second lower insulation interior cover 60 positioned extending over the second lower insulation interior surface 59 and adjacent to the second gypsum board construction to facilitate firestopping thereover. These lower insulation interior covers 50 and 60 can be made of a paper material with an intumescent component impregnated therewithin which facilitates firestopping. Further the present invention may include a first angle bracket 51 attached to the first upper insulation section 82 and to the first lower insulation section 44 at a position adjacent to the first gypsum board construction 24 to facilitate positioning of the first insulation member 80 with respect to the head-of-wall area 25 adjacent the first gypsum board construction 24. Additionally a second angle bracket 61 can be included attached to the second upper insulation section 102 and attached to the second lower insulation section 54 at a position adjacent the second gypsum board construction 26 to facilitate positioning of the second insulation 100 with respect to the head-of-wall area 25 adjacent the second gypsum board construction 26.

The first insulation member 80 and the second insulation member 100 are preferably both formed of a resin-impregnated mineral wool or fiber which is formable.

Figure 12:
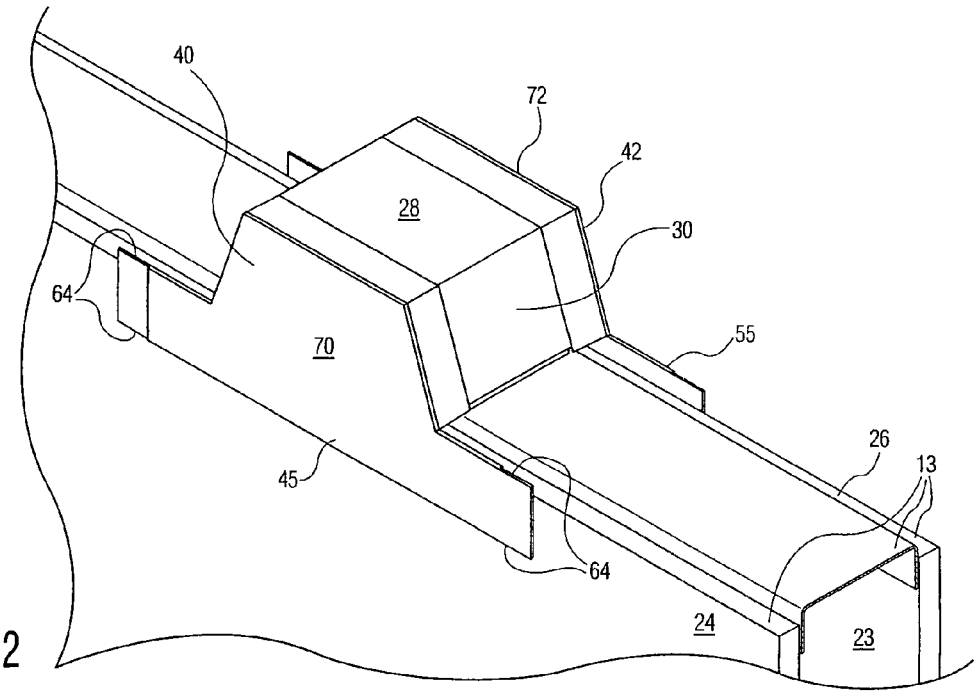
FIG. 12 is a perspective illustration of an alternative embodiment of the head-of-wall firestopping construction of the present invention which includes a construction wherein the first upper insulation member and the second upper insulation member are formed as a single unitary upper insulation member extending upwardly from a first lower insulation section and a second lower insulation section adjacent a wall construction therebelow.

One of the preferred configurations of the present invention is shown in FIG. 12 wherein the first upper insulation section 82 and the second upper insulation section 102 are formed as a single member which is defined in the figures herein as an upper insulation section 30. This single firestopping construction will effectively seal both sides of the head-of-wall area simultaneously by placement of a single fixture. It is designed to be used below a ceiling 12 which includes a fluted ceiling deck 10 which defines at least one ceiling runner channel 11 therein with recessed areas 15 facing downwardly toward the head-of-wall area 25 therebelow. The ceiling runner channels 11 will include upper recess panels 16 extending generally horizontally and including a first recess side panel 18 engaging the upper recess panels 16 and extending downwardly and outwardly therefrom and including a second recess side panel 20 engaging the upper recess panel 16 at a position spatially disposed from the first recess side panel 18 and extending downwardly and outwardly from the upper recess panel 16 in a direction extending away from the first recess side panel. This configuration for the fluted ceiling deck 10 will be positioned above the head-of-wall area 25. Below the head-of-wall area 25 the wall construction 13 will be defined extending generally vertically and will include a plurality of wall studs 23 of wood, metal or other material with a first gypsum board construction 24 extending along one face thereof and second gypsum board construction 26 extending across the opposite face therefrom. The head-of-wall firestopping construction usable with this embodiment of the present invention will include an insulation member of fire insulating material positioned extending into a recessed area 15 defined in the ceiling 12 and will be in frictional engagement with respect to the fluted ceiling deck 10 and will extend downwardly therefrom into the head-of-wall area 25 therebelow. The insulation member 28 will include an upper insulation section of fire insulating material extending into the recessed area 15 defined thereabove in a ceiling runner channel 11 in a ceiling 12 into abutment with respect to the fluted ceiling deck 10 in the recessed area 15 thereof. The upper insulation section 30 will include an upper insulation horizontal surface 32 defined extending approximately horizontally thereon. Upper insulation section 30 will further define an upper insulation primary inclined surface 34 attached to the upper insulation horizontal surface 32 and extending downwardly and outwardly therefrom. The upper insulation primary inclined surface 34 will be positioned in abutment with a first recess side panel 18 for facilitating frictionally movable attachment with respect thereto.

Upper insulation section 30 will further include an upper insulation secondary inclined surface 38 attached to the upper insulation horizontal surface 32 at a position spatially disposed from the upper insulation primary inclined surface 34 and extending downwardly and outwardly therefrom. The upper insulation secondary inclined surface 38 will be positioned in abutment with a second recess side panel 20 for facilitating frictionally movable attachment with respect thereto. Upper insulation section 30 will further include a first upper insulation exterior surface 40 extending generally vertically and facing outwardly with respect to the head-of-wall area 25 above the first gypsum board construction 24. Also included will be a second upper insulation exterior surface 42 extending generally vertically and facing outwardly with respect to the head-of-wall area 25 positioned extending outwardly and above the second gypsum board construction 26.

The head-of-wall area firestopping construction will include a first cover 70 attached to the insulation member 28 and positioned extending at least partially across the first upper insulation exterior surface 40 and extending at least partially across the first lower insulation exterior surface 45 for enhancing firestopping by the insulation member 28. Further included in the construction of the head-of-wall firestopping device will be a second cover 72 attached to the insulation member 28 and positioned extending at least partially across the second upper insulation exterior surface 42 and extending at least partially across the second lower insulation exterior surface 55 for enhancing firestopping of the insulation member 28.

Figure 2:
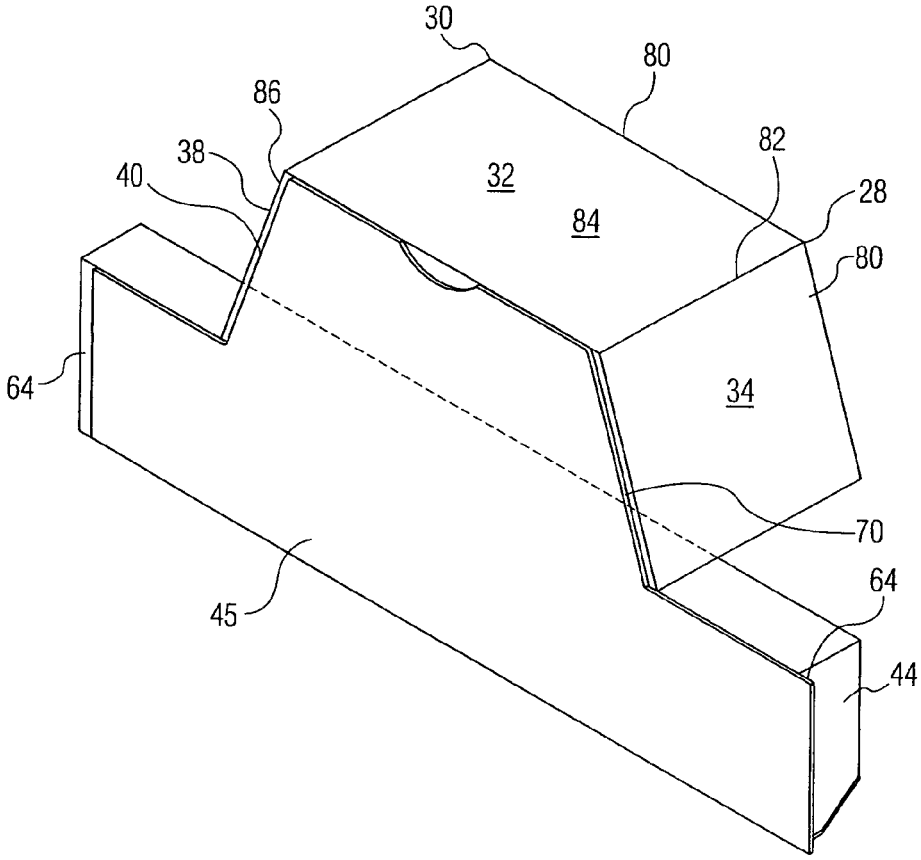
FIG. 2 is a perspective illustration of an embodiment of a first insulation member of the head-of-wall firestopping construction of the present invention.
Figure 3:
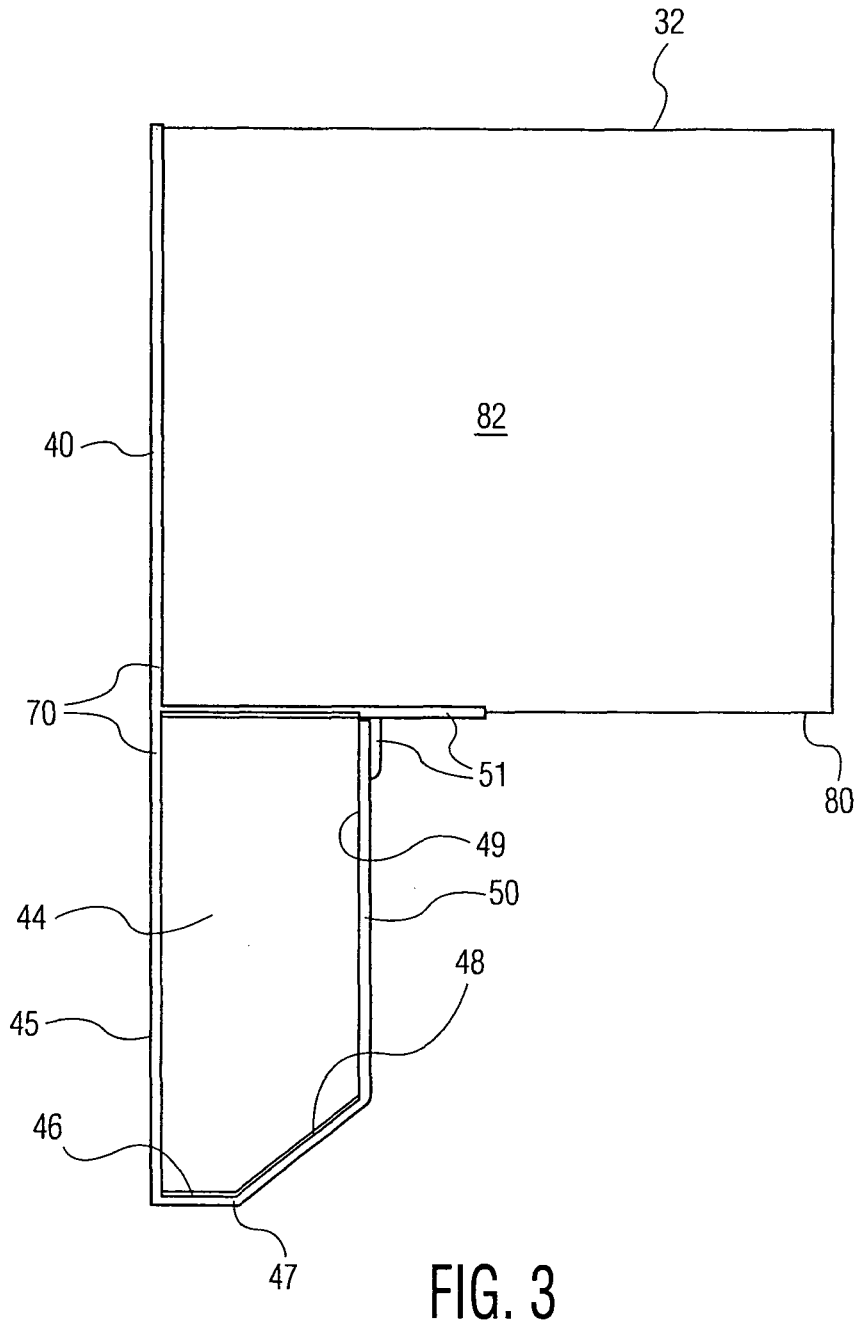
FIG. 3 is a side cross-sectional view of an embodiment of a first insulation member of the head-of-wall firestopping construction of the present invention.
Figure 4:
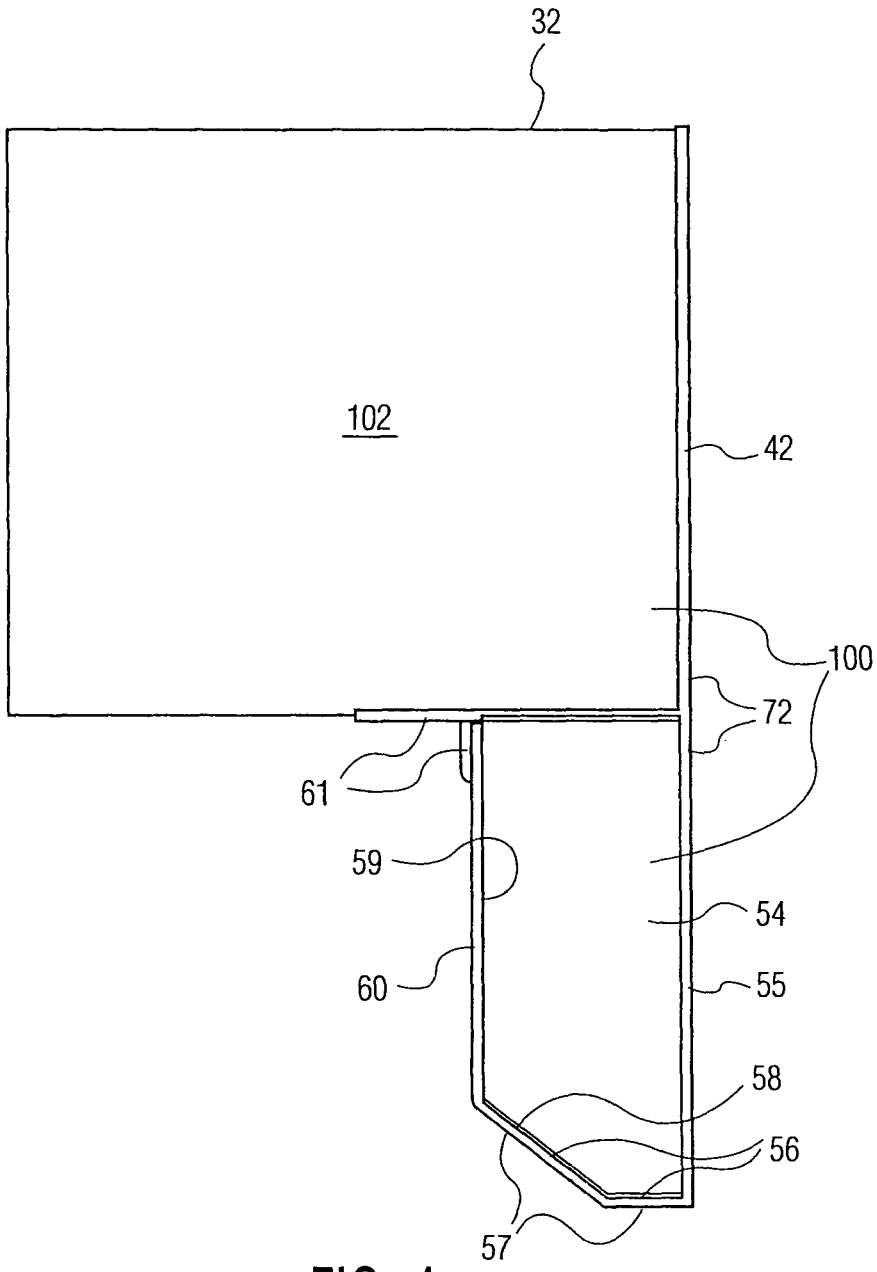
FIG. 4 is a side cross-sectional view of an embodiment of a second insulation member of the head-of-wall firestopping construction of the present invention.
Figure 5:
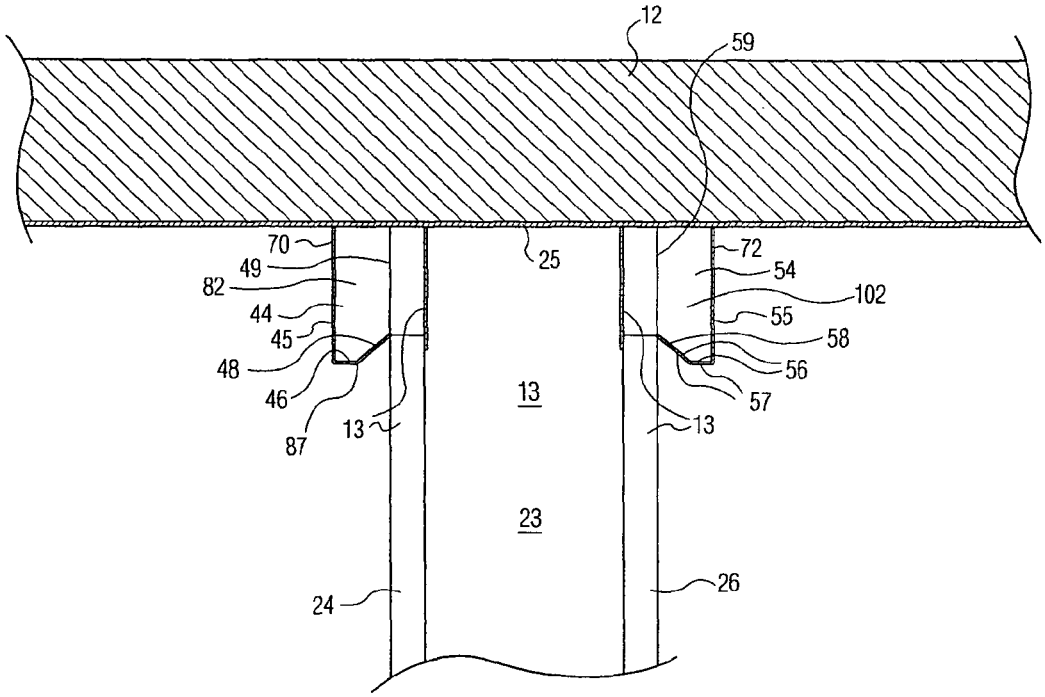
FIG. 5 is a side cross-sectional view of an embodiment of the head-of-wall firestopping construction of the present invention shown installed beneath and extending upwardly into engagement with a ceiling thereabove having a fluted ceiling deck for firestopping across the head-of-wall area thereadjacent.
Figure 6:
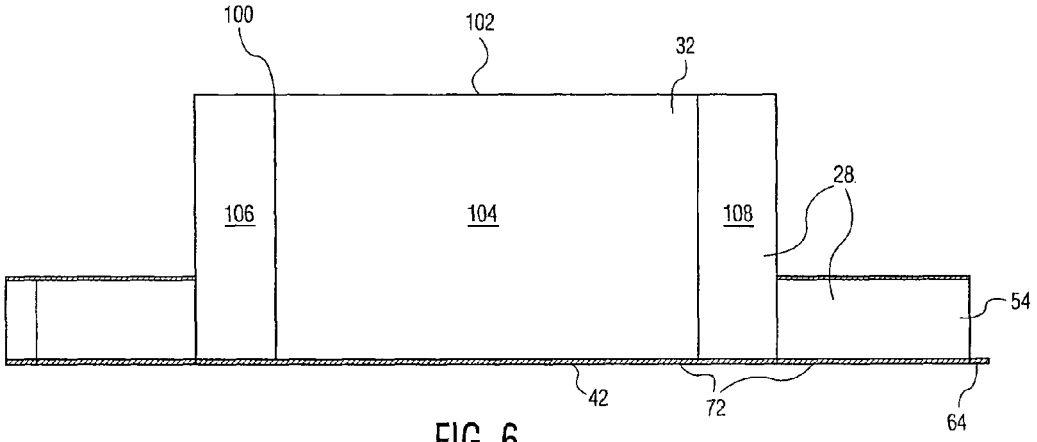
FIG. 6 is a top plan view of an embodiment of a second insulation member of the head-of-wall firestopping construction of the present invention.
Figure 7:
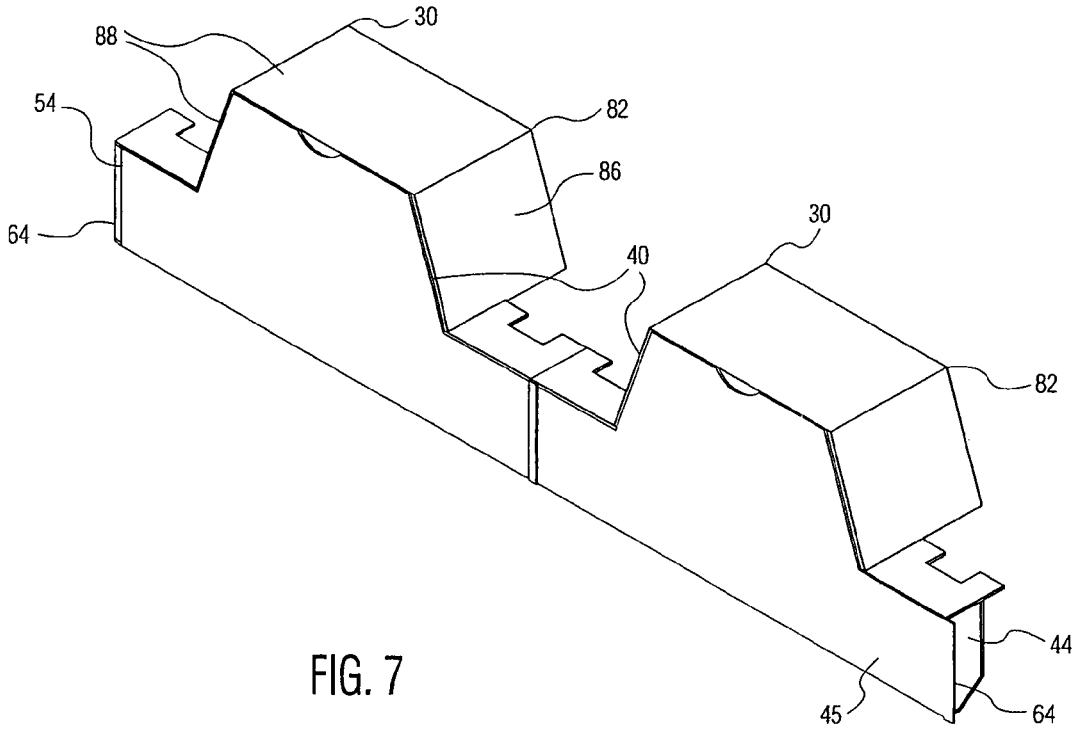
FIG. 7 is a perspective illustration of an embodiment of the head-of-wall firestopping construction of the present invention shown in position with multiple first insulation members positioned adjacently to firestop along a large expanse of a fluted ceiling deck positioned thereabove.
Figure 8:
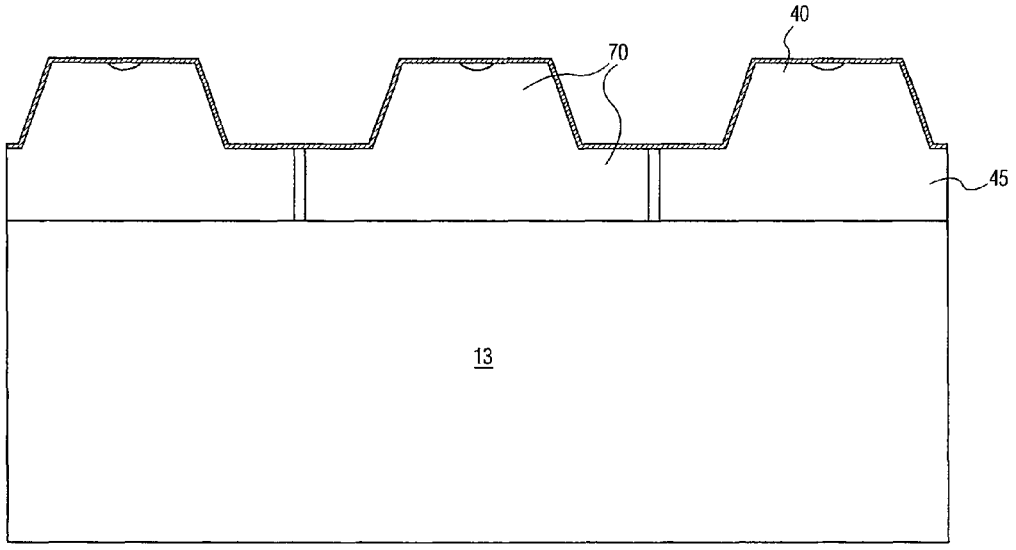
FIG. 8 is a front plan view of multiple similarly configured embodiments of the first cover of the present invention shown positioned above a wall construction therebelow.
Figure 9:
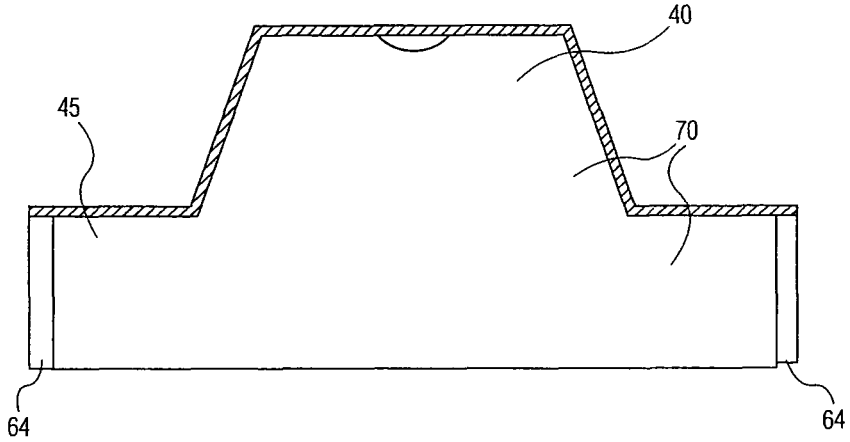
FIG. 9 illustrates a side plan view an embodiment of a first cover of the head-of-wall firestopping construction of the present invention.
Figure 10:
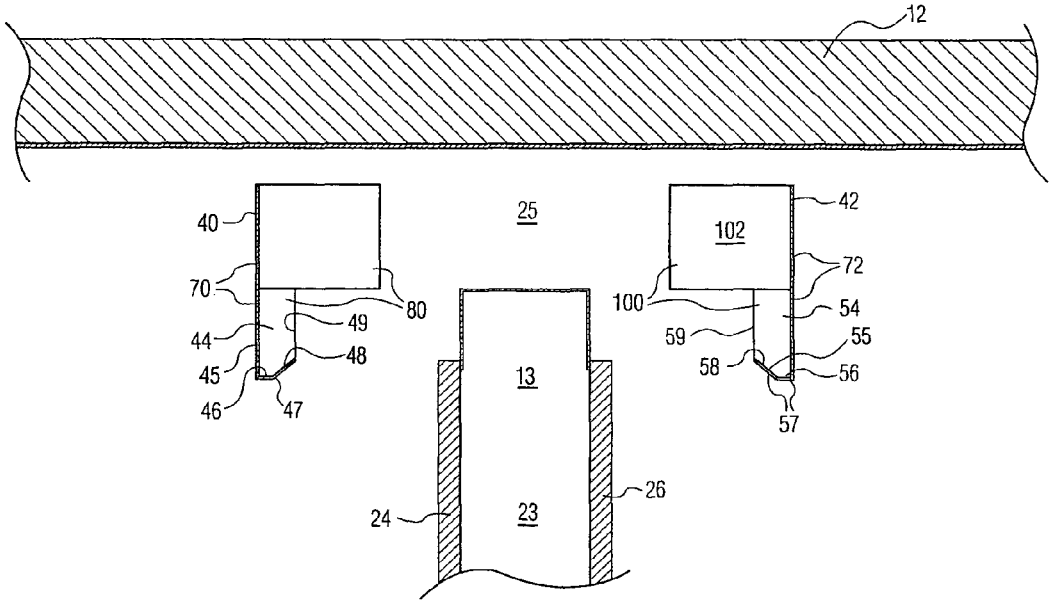
FIG. 10 is an exploded illustration of an embodiment of the head-of-wall firestopping construction of the present invention shown with the first insulation member and the second insulation member displaced laterally outwardly for purposes of illustration.
Figure 11:
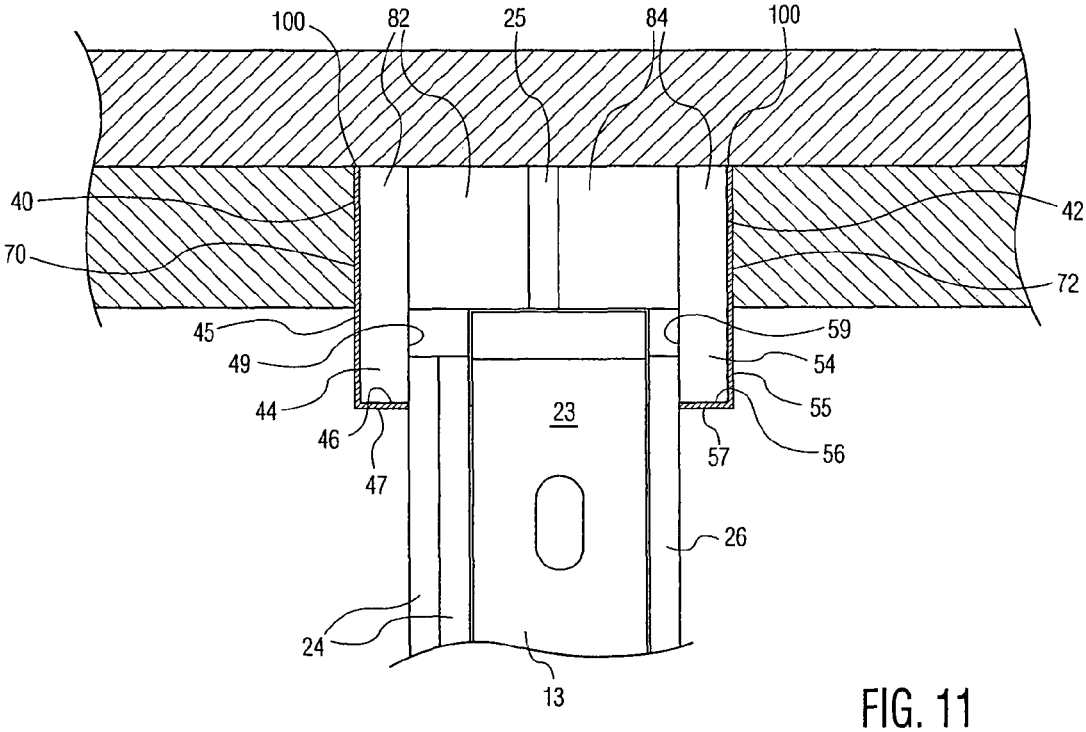
FIG. 11 is a side cross-sectional view of an embodiment of the head-of-wall firestopping construction of the present invention shown positioned for firestopping within the head-of-wall area between the wall construction therebelow and the fluted ceiling deck thereabove.

One of the important characteristics of the present invention is the including of male and female overlapping sections which will enhance the finished appearance and securement of this configuration of the head-of-wall firestopping construction of the present invention with respect to the portions of the ceiling 12 and wall construction 13 immediately thereadjacent. These overlapping sections are shown in various drawings including FIG. 2 which shows the extended portion 64 in the righthand portion of the drawings and the reduced section 64. As such, the seams defined in the lower insulation members will not align with the seams of the covers 70 and 72. See also FIG. 7 which shows similar overlapping panels 64.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. A head-of-wall firestopping construction positionable in a head-of-wall area defined between a ceiling thereabove and a wall construction therebelow wherein the ceiling includes a fluted ceiling deck which defines at least one ceiling runner channel therein with recessed areas defined therein facing downwardly toward the head-of-wall area therebelow with the at least one ceiling runner channel including an upper recess panel extending generally horizontally and including a first recess side panel engaging the upper recess panel and extending downwardly and outwardly therefrom and including a second recess side panel engaging the upper recess panel at a position spatially disposed from the first recess side panel and extending downwardly and outwardly from the upper recess panel in a direction extending away from the first recess side panel, the head-of-wall firestopping construction also being for use with a wall construction extending generally vertically and positioned below the head-of-wall area which includes a plurality of wall studs with a first gypsum board construction attached thereto and a second gypsum board construction attached thereto at a position spatially disposed from the first gypsum board construction, said head-of-wall firestopping construction including:

A. a first insulation member of fire insulating material positioned extending into one of said recessed areas defined in the ceiling and being in frictional engagement with respect to the fluted ceiling deck and extending downwardly therefrom into the head-of-wall area, said first insulation member comprising:

(1) a first upper insulation section of fire insulating material extending into one of said recessed areas defined thereabove in at least one ceiling runner channel in the ceiling into abutment with respect to the fluted ceiling deck in one of said recessed areas thereof, said first upper insulation section including:

(a) a first upper insulation horizontal surface defined extending horizontally thereon;

(b) a first upper insulation primary inclined surface attached to said first upper insulation horizontal surface and extending downwardly and outwardly therefrom, said first upper insulation primary inclined surface being positioned in abutment with the first recess side panel for facilitating frictionally movable attachment with respect thereto;

(c) a first upper insulation secondary inclined surface attached to said first upper insulation horizontal surface at a position spatially disposed from said first upper insulation primary inclined surface and extending downwardly and outwardly therefrom, said first upper insulation secondary inclined surface being positioned in abutment with the second recess side panel for facilitating frictionally movable attachment with respect thereto;

(d) a first upper insulation exterior surface extending generally vertically and facing outwardly with respect to the head-of-wall area above the first gypsum board construction;

(2) a first lower insulation section of fire insulating material attached to said first upper insulation section and extending downwardly therefrom to a position in abutment with and extending over the first gypsum board construction for firestopping thereadjacent, said first lower insulation section defining a first lower insulation exterior surface extending generally vertically and facing outwardly from the head-of-wall area;

B. a second insulation member of fire insulating material positioned extending into one of said recessed areas defined in the ceiling and being in frictional engagement with respect to the fluted ceiling deck and extending downwardly therefrom into the head-of-wall area, said second insulation member comprising:

(1) a second upper insulation section of fire insulating material extending into one of said recessed areas defined thereabove in a ceiling runner channel in the ceiling into abutment with respect to the fluted ceiling deck in one of said recessed areas thereof, said second upper insulation section including:

(a) a second upper insulation horizontal surface defined extending horizontally thereon;

(b) a second upper insulation primary inclined surface attached to said second upper insulation surface horizontal surface and extending downwardly and outwardly therefrom, said second upper insulation primary inclined surface being positioned in abutment with the first recess side panel for facilitating frictionally movable attachment with respect thereto;

(c) a second upper insulation secondary inclined surface attached to said second upper insulation surface horizontal surface at a position spatially disposed from said second upper insulation primary inclined surface and extending downwardly and outwardly therefrom, said second upper insulation secondary inclined surface being positioned in abutment with a second recess side panel for facilitating frictionally movable attachment with respect thereto;

(d) a second upper insulation exterior surface extending generally vertically and facing outwardly with respect to the head-of-wall area positioned extending outwardly and above the second gypsum board construction;

(2) a second lower insulation section of fire insulating material attached to said second upper insulation section at a position spatially disposed from said first lower insulation section and extending downwardly therefrom to a position in abutment with and extending over the second gypsum board construction for firestopping thereadjacent, said second lower insulation section defining a second lower insulation exterior surface extending generally vertically and facing outwardly from the head-of-wall area;

C. a first cover attached to said first insulation member and positioned extending at least partially across said first upper insulation exterior surface and at least partially across said first lower insulation exterior surface for enhancing firestopping of said first insulation member; and D. a second cover attached to said second insulation member and positioned extending at least partially across said second upper insulation exterior surface and at least partially across said second lower insulation exterior surface for enhancing firestopping of said second insulation member.

2. A head-of-wall firestopping construction as defined in claim 1 wherein said first insulation member and said second insulation member are made of a molded mineral wool material.

3. A head-of-wall firestopping construction as defined in claim 1 wherein said first cover and said second cover are made of a paper material with an intumescent component impregnated therewithin.

4. A head-of-wall firestopping construction as defined in claim 1 wherein said first upper insulation section of said first insulation member and said second upper insulation section of said second insulation member are positioned spatially disposed apart within the head-of-wall area and extending into the recessed area to facilitate use of the head-of-wall firestopping construction for firestopping wall constructions.

5. A head-of-wall firestopping construction as defined in claim 1 wherein said first upper insulation section of said first insulation member and said second upper insulation section of said second insulation member are positioned in direct abutment within the head-of-wall area and extending into the recessed area to facilitate firestopping of the head-of-wall area.

6. A head-of-wall firestopping construction as defined in claim 1 wherein said first lower insulation section defines a first lower insulation lower surface facing generally downwardly and wherein said second lower insulation section defines a second lower insulation lower surface facing generally downwardly, and wherein said head-of-wall firestopping construction further includes a first lower surface lower cover extending over said first lower insulation lower surface and further includes a second lower surface lower cover extending over said second lower insulation surface for enhancing firestopping of said first lower insulation section and said second lower insulation section.

7. A head-of-wall firestopping construction as defined in claim 6 wherein said first lower surface lower cover and said second lower surface lower cover are made of a paper material with an intumescent component impregnated therewithin to facilitate firestopping.

8. A head-of-wall firestopping construction as defined in claim 6 wherein said first lower insulation lower surface includes a first lower insulation lower truncated surface positioned immediately adjacent to the first gypsum board construction and oriented inclined upwardly and inwardly with respect thereto to facilitate relative movement of the first gypsum board construction upwardly into a position between the wall studs and said first lower insulation section during construction thereof.

9. A head-of-wall firestopping construction as defined in claim 8 wherein said second lower insulation lower surface includes a second lower insulation lower truncated surface positioned immediately adjacent to the second gypsum board construction and oriented inclined upwardly and inwardly with respect thereto to facilitate relative movement of the second gypsum board construction upwardly into a position between the wall studs and said second lower insulation section during construction thereof.

10. A head-of-wall firestopping construction as defined in claim 1 wherein said first lower insulation section includes a first lower insulation interior surface positioned immediately adjacent to and facing the first gypsum board construction to facilitate firestopping thereadjacent and wherein said second lower insulation section includes a second lower insulation interior surface positioned immediately adjacent to and facing the second gypsum board construction to facilitate firestopping thereadjacent.

11. A head-of-wall firestopping construction as defined in claim 10 further comprising a first lower insulation interior cover positioned extending over said first lower insulation interior surface and adjacent to the first gypsum board construction to facilitate firestopping thereover and further comprising a second lower insulation interior cover positioned extending over said second lower insulation interior surface and adjacent to the second gypsum board construction to facilitate firestopping thereover.

12. A head-of-wall firestopping construction as defined in claim 11 wherein said first lower insulation interior cover and said second lower insulation interior cover are made of a paper material with an intumescent component impregnated therewithin to facilitate firestopping.

13. A head-of-wall firestopping construction as defined in claim 1 further including a first angle bracket attached to said first upper insulation section and to said first lower insulation section at a position adjacent the first gypsum board construction to facilitate positioning of said first insulation member with respect to the head-of-wall area adjacent the first gypsum board construction.

14. A head-of-wall firestopping construction as defined in claim 1 further including a second angle bracket attached to said second upper insulation section and to said second lower insulation section at a position adjacent the second gypsum board construction to facilitate positioning of said second insulation member with respect to the head-of-wall area adjacent the second gypsum board construction.

15. A head-of-wall firestopping construction as defined in claim 1 wherein said first insulation member and said second insulation member are both formed of a resin-impregnated formable mineral wool material.

16. A head-of-wall firestopping construction positionable in a head-of-wall area defined between a ceiling thereabove and a wall construction therebelow wherein the ceiling includes a fluted ceiling deck which defines at least one ceiling runner channel therein with recessed areas defined therein facing downwardly toward the head-of-wall area therebelow with the at least one ceiling runner channel including an upper recess panel extending generally horizontally and including a first recess side panel engaging the upper recess panel and extending downwardly and outwardly therefrom and including a second recess side panel engaging the upper recess panel at a position spatially disposed from the first recess side panel and extending downwardly and outwardly from the upper recess panel in a direction extending away from the first recess side panel, the head-of-wall firestopping construction also being for use with a wall construction extending generally vertically and positioned below the head-of-wall area which includes a plurality of wall studs with a first gypsum board construction attached thereto and a second gypsum board construction attached thereto at a position spatially disposed from the first gypsum board construction, said head-of-wall firestopping construction including:

A. an insulation member of fire insulating material positioned extending into one of said recessed areas defined in the ceiling and being in frictional engagement with respect to the fluted ceiling deck and extending downwardly therefrom into the head-of-wall area, said insulation member comprising:

(1) an upper insulation section of fire insulating material extending into one of said recessed areas defined thereabove in at least one ceiling runner channel in the ceiling into abutment with respect to the fluted ceiling deck in one of the recessed areas thereof, said upper insulation section including:

(a) an upper insulation horizontal surface defined extending horizontally thereon;

(b) an upper insulation primary inclined surface attached to said upper insulation horizontal surface and extending downwardly and outwardly therefrom, said upper insulation primary inclined surface being positioned in abutment with the first recess side panel for facilitating frictionally movable attachment with respect thereto;

(c) an upper insulation secondary inclined surface attached to said upper insulation horizontal surface at a position spatially disposed from said upper insulation primary inclined surface and extending downwardly and outwardly therefrom, said upper insulation secondary inclined surface being positioned in abutment the second recess side panel for facilitating frictionally movable attachment with respect thereto;

(d) a first upper insulation exterior surface extending generally vertically and facing outwardly with respect to the head-of-wall area above the first gypsum board construction;

(e) a second upper insulation exterior surface extending generally vertically and facing outwardly with respect to the head-of-wall area positioned extending outwardly and above the second gypsum board construction;

(2) a first lower insulation section of fire insulating material attached to said upper insulation section and extending downwardly therefrom to a position in abutment with and extending over the first gypsum board construction for firestopping thereadjacent, said first lower insulation section defining a first lower insulation exterior surface extending generally vertically and facing outwardly with respect to the head-of-wall area;

(3) a second lower insulation section of fire insulating material attached to said upper insulation section at a position spatially disposed from said first lower insulation section and extending downwardly therefrom to a position in abutment with and extending over the second gypsum board construction for firestopping thereadjacent, said second lower insulation section defining a second lower insulation exterior surface extending generally vertically and facing outwardly with respect to the head-of-wall area;

B. a first cover attached to said insulation member and positioned extending at least partially across said first upper insulation exterior surface and extending at least partially across said first lower insulation exterior surface for enhancing firestopping by said insulation member; and C. a second cover attached to said insulation member and positioned extending at least partially across said second upper insulation exterior surface and extending at least partially across said second lower insulation exterior surface for enhancing firestopping of said insulation member.

17. A head-of-wall firestopping construction as defined in claim 16 wherein said upper insulation section, said first lower insulation section and said second lower insulation section are each made of a molded mineral wool material.

18. A head-of-wall firestopping construction as defined in claim 16 wherein said first cover and said second cover are made of a paper material with an intumescent component impregnated therewithin.

* * * * *